US007296943B2

(12) United States Patent
Sandoval

(10) Patent No.: US 7,296,943 B2
(45) Date of Patent: Nov. 20, 2007

(54) BASEBOARD CLEANING APPARATUS AND METHOD

(76) Inventor: Yvonne Sandoval, 1660 CR 311, Jarrell, TX (US) 76537

( * ) Notice: Subject to any disclaimer, the term of this patent is extended or adjusted under 35 U.S.C. 154(b) by 469 days.

(21) Appl. No.: 10/715,134

(22) Filed: Nov. 17, 2003

(65) Prior Publication Data

US 2006/0182487 A1 Aug. 17, 2006

Related U.S. Application Data

(60) Provisional application No. 60/426,856, filed on Nov. 15, 2002.

(51) Int. Cl.
*A46B 11/00* (2006.01)
*A46B 15/00* (2006.01)
*A47L 1/08* (2006.01)

(52) U.S. Cl. ..... 401/140; 401/9; 401/48; 401/23; 401/39

(58) Field of Classification Search ..... 401/9, 401/23, 24, 37, 38, 39, 48, 137, 138, 139, 401/140; 15/210.1, 244.1, 107, 116.2
See application file for complete search history.

(56) References Cited

U.S. PATENT DOCUMENTS 1,542,925 A * 6/1925 Wambold ..... 401/155
2,610,346 A * 9/1952 Pugh ..... 15/210.1
3,042,952 A 7/1962 Bradley
3,339,220 A 9/1967 Barry
3,457,016 A * 7/1969 Gotberg ..... 401/131
3,713,744 A 1/1973 Sims
4,024,597 A 5/1977 Fouracre
4,542,549 A * 9/1985 Keller ..... 15/1.7
4,606,092 A 8/1986 Henning
5,050,530 A * 9/1991 Studebaker et al. ..... 118/264
5,371,912 A 12/1994 Hall
6,065,890 A * 5/2000 Weitz ..... 401/146
6,554,902 B2 * 4/2003 Yan ..... 118/264

* cited by examiner

*Primary Examiner*—David J. Walczak
(74) *Attorney, Agent, or Firm*—Meyertons, Hood, Kivlin, Kowert & Goetzel, P.C.; Eric B. Meyertons

(57) ABSTRACT

An apparatus for cleaning a baseboard of a wall may include pads and a handle. A front surface of at least one of the pads may be configured to contact a portion of the baseboard during use. A liquid dispenser may be provided to wet one or more of the pads during use. A portion of the handle may be angled to extend away from the wall and rearward from the pad during use. Top pads may be provided for cleaning a top face of the baseboard. The top pads may be vertically and horizontally adjustable relative to a holder to accommodate baseboards of various dimensions.

16 Claims, 6 Drawing Sheets

BASEBOARD CLEANING APPARATUS AND METHOD

PRIORITY CLAIM

This application claims priority to U.S. Provisional Patent Application Ser. No. 60/426,856 filed on Nov. 15, 2002, entitled "BASEBOARD CLEANING APPARATUS AND METHOD", the disclosure of which is hereby incorporated by reference.

BACKGROUND

1. Field of the Invention

The present invention generally relates to an apparatus and method for cleaning baseboards in residences and commercial buildings. More particularly, the invention relates to a baseboard cleaner that will not damage the baseboard and that may be operated without extensive bending or stooping.

2. Description of Related Art

Baseboards along the bottom edge of walls are customarily cleaned by a broom or by hand. Cleaning a baseboard with a broom may scratch the baseboard. Hand cleaning by an individual may require bending, stooping, and/or kneeling for prolonged periods. Such activities may cause discomfort or injury (e.g., back injury) to the individual performing the cleaning operation.

Some devices are known for cleaning baseboards. U.S. Pat. No. 3,042,952 to Bradley, which is incorporated by reference as if fully set forth herein, describes a baseboard duster and applicator having a pair of parallel upright plates spaced apart by one or more supporting members. A pair of rollers is included between the plates. A pad is secured to one or both exterior surfaces of the plates for dusting or applying wax or oil to the baseboard. A handle is pivotally coupled between the plates. The handle may be rotated to alternately position the pads on either side of the apparatus for contact with the baseboard.

U.S. Pat. No. 3,339,220 to Barry, which is incorporated by reference as if fully set forth herein, describes a device for cleaning corner surfaces. The device includes a right-angled scrubber head attached to a straight elongated handle. The device is adapted for simultaneously cleaning intersecting surfaces such as the adjoining areas of a baseboard and a floor.

U.S. Pat. No. 3,713,744 to Sims, which is incorporated by reference as if fully set forth herein, describes a combination cleaner, polisher and waxing device for walls and floors. The device includes an elongated handle having a pad carrier pivotally connected to the handle. One side margin of the carrier is weighted so that the carrier tends to a vertical position for wall cleaning when held spaced above a floor.

Many currently available cleaning devices do not provide multiple cleaning pads adapted to perform multiple cleaning steps, such as wetting and drying, in a single operation. In addition, many currently available cleaning devices do not provide a handle that is adapted for comfortable gripping and ease of operation. Many currently available devices do not allow for adjustment of pads to clean baseboards of various heights and widths. It is desirable to have a baseboard cleaner that is adapted to perform multiple cleaning steps in a single operation, that can be comfortably and easily operated by a user, and with pads that may be adjusted for cleaning baseboards of various dimensions.

SUMMARY

In an embodiment, an apparatus for cleaning a baseboard of a wall may include pads and a handle coupled to the pads. The front surfaces of the pads may be configured to contact adjoining sections of the baseboard during use. In certain embodiments, one of the pads may be a sponge and another pad may be a dry cloth. A liquid dispenser such as a water bottle may be coupled to the sponge to wet the sponge during use. In another embodiment, one pad may be a dust cloth that is adapted to collect dust, and another pad may be a polishing cloth. One or more of the pads may be removable, reversible, washable, and/or replaceable.

In an embodiment, an apparatus for cleaning a baseboard of a wall may include one or more rollers. A portion of a handle may be angled to extend away from the wall and rearward from one or more of the pads during use. The handle may include a grip end portion that is angled with respect to an adjoining portion of the handle for the comfort of a user.

In an embodiment, a length of a handle of an apparatus may be adjustable for use by users of various heights. In some embodiments, a middle portion of a handle may be rotatably coupled to a base portion so that the middle portion of the handle can be adjusted during use or storage of the apparatus.

In an embodiment, an apparatus for cleaning a baseboard may include one or more top pads for cleaning a top face of a baseboard. The top pads may be adjustable to facilitate cleaning of baseboards of various dimensions. In some embodiments, top pads may be vertically adjustable relative to the holder. A user may vertically adjust the top pads of the apparatus to facilitate cleaning of baseboards of various heights. In other embodiments, top pads may be horizontally adjustable relative to a holder. A user may horizontally adjust the top pads to facilitate cleaning of baseboards of various thicknesses.

BRIEF DESCRIPTION OF THE DRAWINGS

Advantages of the present invention will become apparent to those skilled in the art with the benefit of the following detailed description and upon reference to the accompanying drawings in which.

Figure 1:
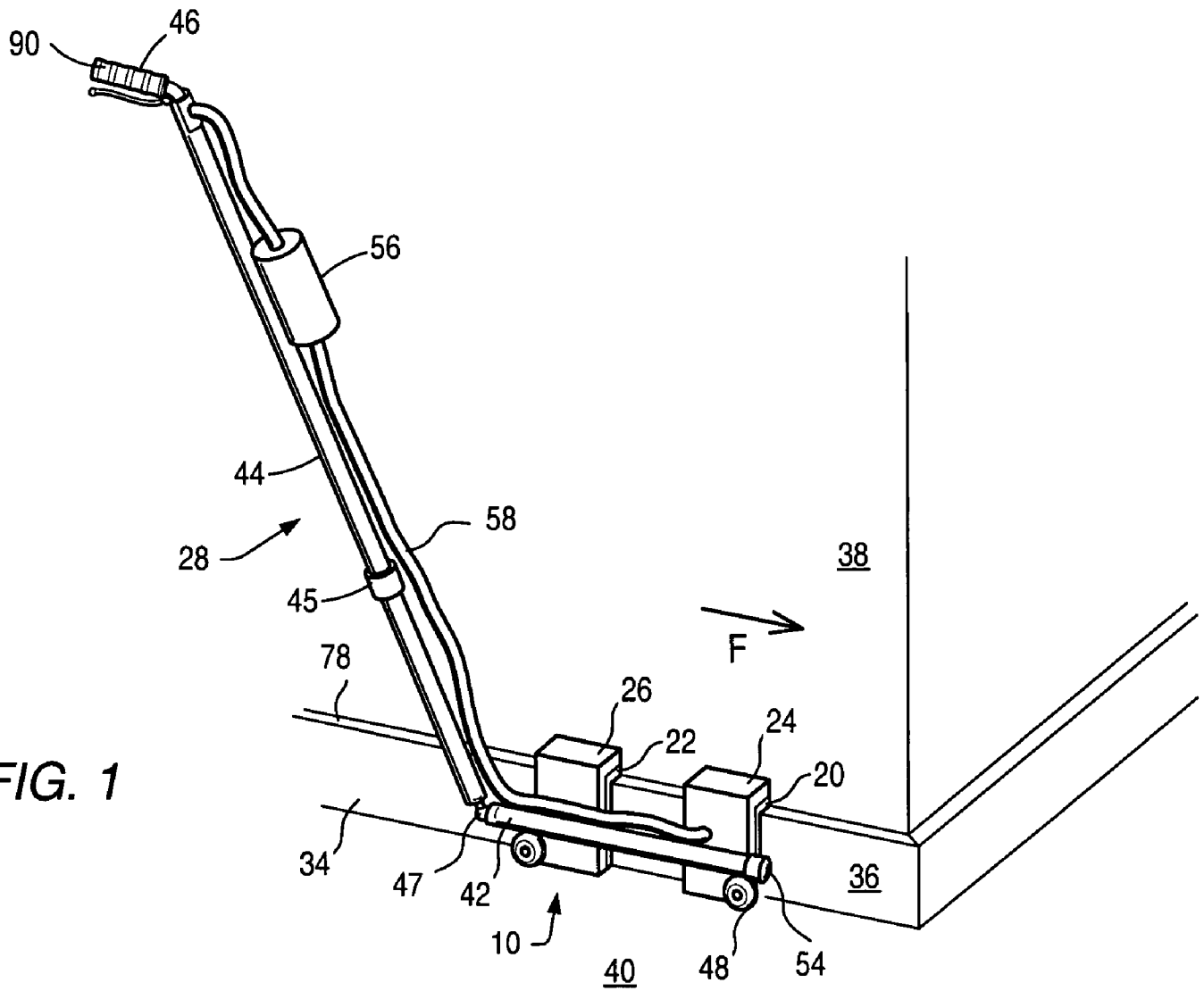
FIG. 1 depicts an embodiment of a baseboard cleaner.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE INVENTION

Referring to the drawings, an apparatus for cleaning a baseboard is designated generally as 10. FIGS. 1-4 show apparatus 10 including pads 20, 22. Pads 20, 22 may be installed on pad holders 24, 26. In an embodiment, pad 20 may be a sponge and pad 22 may be a dry cloth. Pad holders 24, 26 may be coupled to handle 28.

In use, front surfaces 30, 32 of pads 20, 22, respectively (shown in FIG. 4), may be positioned to contact front face 34 of baseboard 36. Baseboard 36 may be attached at a junction of wall 38 and floor 40. Front surfaces 30, 32 of pads 20, 22 may be configured to contact adjoining surfaces of baseboard 36 so that a user may apply pads 20, 22 sequentially along a given section of baseboard 36. For example, front surfaces 30, 32 may be substantially in line such that front surfaces 30, 32 lie in a common plane and are positioned along a common longitudinal axis in direction F of FIG. 1. In one embodiment, adjacent edges of pads 20 and 22 may be positioned so that there is no gap between the edges of the pads. In another embodiment, pads 20 and 22 may be spaced from each other so that there is a gap between the edges of the pads.

Handle 28 may include base portion 42, middle portion 44, and grip end portion 46. Base portion 42 may be substantially parallel to the baseboard 36 during use. Middle portion 44 may be angled upwardly with respect to base portion 42 so that a user may reach grip end portion 46 of handle 28 without stooping. Middle portion 44 may be angled outwardly with respect to front surfaces 30, 32 so that grip end portion 46 is positioned away from wall 38 during use.

In an embodiment, grip end portion 46 may be angled with respect to middle portion 44. The angle may be chosen such that the handle is comfortable for a user. For example, grip end portion 46 may be angled from middle portion 44 so that a longitudinal axis of grip end portion 46 is about 15 degrees out of a vertical plane parallel to wall 38, and about 45 degrees out of a vertical plane perpendicular to wall 38.

In some embodiments, handle 28 may be adjustable. For example, a telescoping feature may be provided on middle portion 44 so that the overall length of handle 28 is adjustable. Threaded adjustment ring 45 may be provided on middle portion 44 to allow a user to control the extension of an upper section of middle portion 44 relative to a lower section of middle portion 44. As another example, a pivot or ball joint 47 may be used to couple middle portion 44 and base portion 42. Ball joint 47 may include a locking element for fixing an angle between middle portion 44 and base portion 42 during use. Such locking elements may include, but are not limited to, a latch, a screw, a pin, a detent mechanism, and/or a clip. Similar coupling and/or locking features may be provided between middle portion 44 and grip end portion 46. In an embodiment, frictional engagement at ball joint 47 may inhibit handle 28 from dropping to the floor even if a user releases the handle.

Features allowing adjustment of a handle may facilitate use of the apparatus by users of various heights. Features allowing adjustment of a handle may make the apparatus easier to operate, transport, or store. For example, a user may be able to increase an angle between middle portion 44 and base portion 42 to an angle that approaches 180 degrees. Such an angle may allow a user to operate the apparatus underneath obstructions, such as furniture or office equipment.

Figure 2:
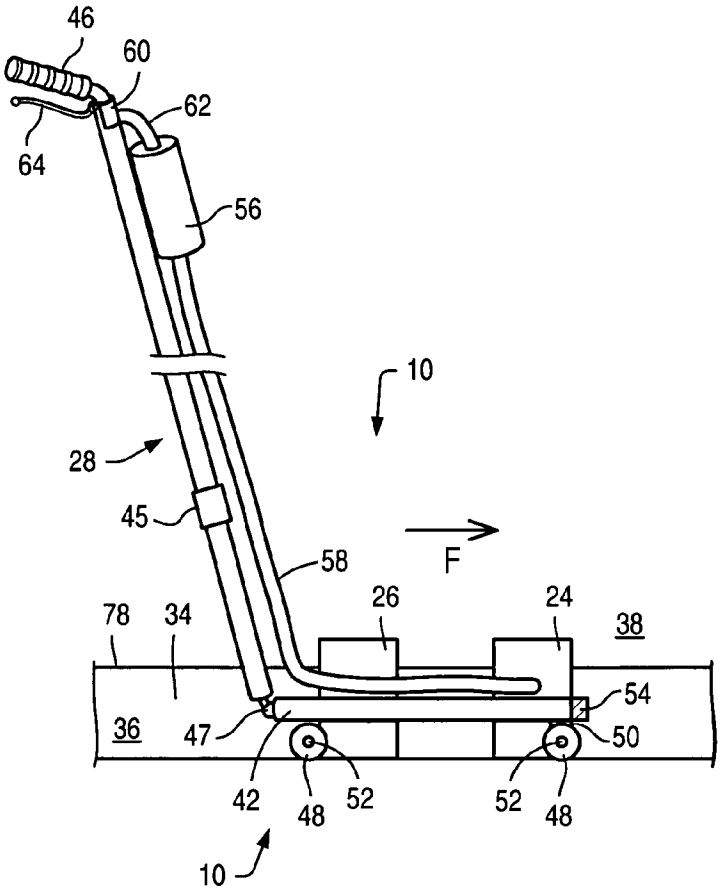
FIG. 2 depicts a baseboard cleaner against a baseboard.

In an embodiment, apparatus 10 may include rollers 48. Rollers 48 may be configured to roll on floor 40 to facilitate travel of pads 20, 22 along a length of baseboard 36. Rollers 48 may facilitate guiding of the apparatus around corners. Rollers 48 may be any of various forms known to those skilled in the art, including, but not limited to, wheels, bearings, cylinders, or discs. In one embodiment, as shown in FIG. 2, rollers 48 may be wheels mounted to roller mounts 50 on axles 52. In other embodiments, rollers 48 may be mounted to pad holders 24, 26 or handle 28. Stop 54 may be provided to inhibit damage to a wall, baseboard, or other surface, such as banging or scratching, caused by contact with apparatus 10. Stop 54 may be formed of a resilient material (e.g., rubber).

In one embodiment, apparatus 10 may include liquid dispenser 56. Liquid dispenser 56 may be coupled to handle 28. Liquid dispenser 56 may be configured to provide a liquid to pad 20 (e.g., a sponge) through inlet 57 (shown in FIG. 4). The liquid may include, but is not limited to, water, a cleaning solution, oil, and/or wax. Liquid dispenser 56 may be coupled to pad 20 by tube 58. In an embodiment, liquid dispenser 56 may be a squeezable bottle. In another embodiment, as depicted in FIG. 2, liquid dispenser 56 may include a container coupled to pump 60 by tubing 62. Pump 60 may be adapted to pressurize a liquid in the container. Pump 60 may be a manual pump, operated by squeezing lever 64 against grip end portion 46.

Figure 3:
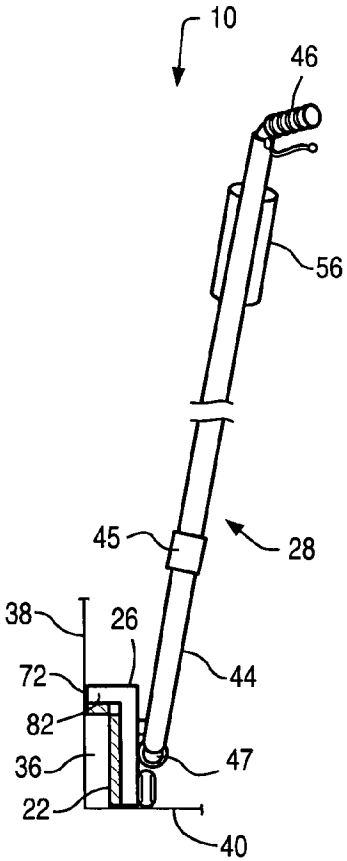
FIG. 3 depicts an end view of the baseboard cleaner of FIG. 2.
Figure 4:
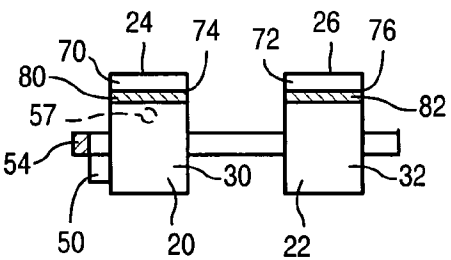
FIG. 4 depicts a front view of the pads of a baseboard cleaner.

FIG. 3 depicts a side view of apparatus 10. FIG. 4 depicts a front view of pads 20, 22. In certain embodiments, pad holders 24, 26 may include lips. Lips 70, 72 may extend from the top edges 74, 76 of pad holders 24, 26, respectively. Lips 70, 72 may be adapted to substantially cover and ride along top face 78 of baseboard 36 during use of apparatus 10. Lip pads 80, 82 may be included on the underside of lips 70, 72, respectively. Lip pads 80, 82 may inhibit damage to top face 78 of baseboard 36 by pad holders 24, 26. Lip pads 80, 82 may clean top face 78 of baseboard 36. Although pads 20, 22 and lip pads 80, 82 are each depicted as separate pads in FIGS. 3 and 4, it will be understood that pad 20 and lip pad 80 may be integrated into a single pad, and that pad 22 and lip pad 82 may be integrated into a single pad. In an embodiment, pad holders 24, 26 may be combined into a single member.

Figure 5:
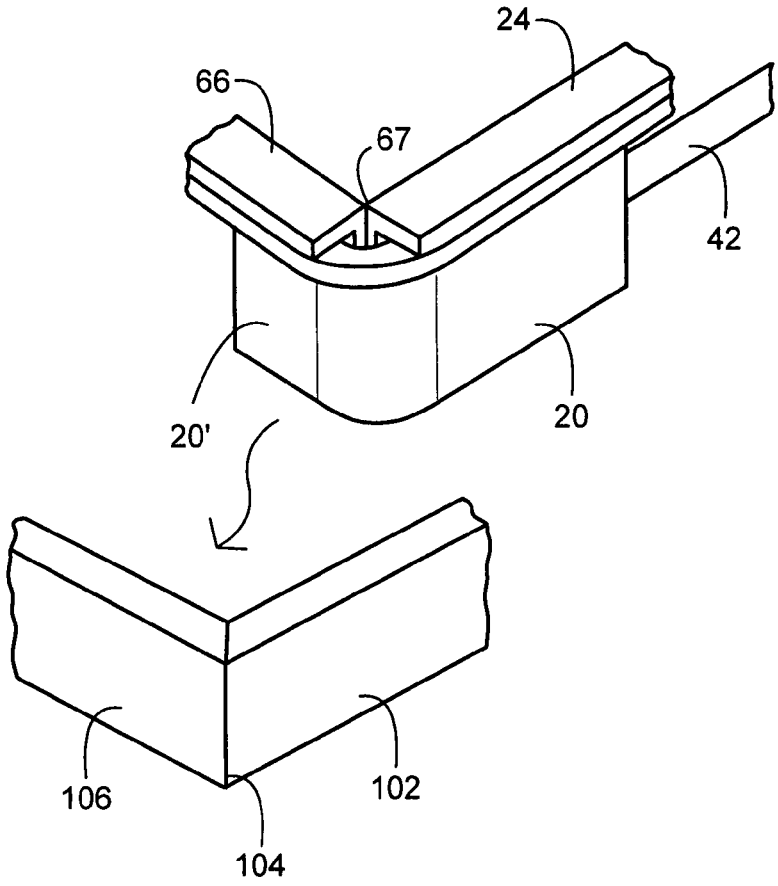
FIG. 5 depicts a pad of a baseboard cleaner that includes a leading portion.

In an embodiment, a pad in a forward position of an apparatus may include a leading portion whose face is at an angle with respect to the rest of the pad. FIG. 5 shows leading portion 20' of pad 20. In another embodiment, leading portion 20' may be a separate pad from pad 20. Forward pad holder 66 may be provided to support leading portion 20'. In some embodiments, forward pad holder 66 may be integrated with or fixedly coupled to pad holder 24. The angle between forward pad holder 66 and pad holder 24 may be about 90 degrees. In other embodiments, forward pad holder 66 may be pivotally coupled to pad holder 24 (e.g., with a pin).

In some embodiments, rollers 48 may be configured to float horizontally relative to pad holders 24, 26. Horizontal float in rollers 48 may allow lip pads 80, 82 to contact top face 78 of baseboard 36 when the rollers 48 are in contact with floor 40, even when variations are encountered in a height of baseboard 36. In one embodiment, axles 52 may be spring-loaded to urge rollers 48 into contact with floor 40.

Pads 20, 22 and lip pads 80, 82 may be any of various cleaning materials known to those skilled in the art. For example, one or more of pads 20, 22 and lip pads 80, 82 may be of nylon wool. In one embodiment, pad 20 may be a sponge and pad 22 may be a dry cloth. In another embodiment, pad 20 may be a dust cloth that is adapted to collect dust, and pad 22 may be polishing pad. Pads 20, 22 and lip pads 80, 82 may be removable from apparatus 10, replaceable, and washable. Pads 20, 22 and lip pads 80, 82 may be reversible so that a user can invert a pad during use and continuing cleaning without having to wash the pad. Utilization of removable, replaceable, washable, and/or reversible pads may make use of apparatus 10 more cost effective. In some embodiments, pads 20, 22 and lip pads 80, 82 may include backing members to provide structural reinforcement to the cleaning surfaces during use, removal, installation, and washing of the pads.

Handle 28 may include any of various materials known to those skilled in the art, including, but not limited to, plastic, metal, and/or wood. In an embodiment, handle 28 may include hollow metal tubing. For example, handle 28 may include hollow aluminum tubing with a circular cross section. The tubing may be bent to form various portions of handle 28 using methods known to those skilled in the art. As depicted in FIG. 1, handle 28 may include grip cover 90. Grip cover 90 may be made of rubber or other resilient material that enhances comfort or adherence to grip end portion 46.

Handle 28 may be coupled to pad holders 24, 26 by various methods known to those skilled in the art. In an embodiment, pad holders 24, 26 are coupled to handle 28 using common fasteners including, but not limited to, bolts, screws, and/or rivets. In some embodiments, pad holders 24, 26 may be coupled to a tube section of handle 28 using a loop-type cushioned clamp. In still another embodiment, pad holders 24, 26 may include through holes adapted to allow a section of handle 28 to pass through the holes. A keying feature, such as are known to those skilled in the art, may be provided on the mating elements to ensure that pads 20, 22 remain properly aligned (e.g., do not rotate around the base portion of handle 28) during use.

During use, a user may configure apparatus 10 to include a sponge as pad 20 and a dry cloth as pad 22. The user may position apparatus 10 so that front surfaces 30, 32 contact baseboard 36. Front surfaces 30, 32 may each contact an adjoining section of baseboard 36. Lever 64 may be depressed to operate pump 60 for liquid dispenser 56, in turn causing the sponge to be wetted. Water in the sponge may contact front face 34 of baseboard 36. The user may grasp grip end portion 46 of handle 28 and push apparatus 10 forward in the direction of arrow F of FIG. 1. Rollers 48 may help a user to maintain pads 20, 22 in contact with front face 34 of baseboard 36. Thus, for example, the sponge (pad 20) may wet and clean a portion of baseboard 36. Thereafter, as the user continues to move the apparatus forward, dry cloth (pad 22) may further clean and dry the portion of baseboard 36. Drying of baseboard 36 immediately after wet washing may inhibit streaking of baseboard 36. Simultaneously, pads 80, 82 may clean top face 78 of baseboard 36. Thus, apparatus 10 may remove dust, stains, and other materials from front face 34 and top face 78 of baseboard 36.

In some embodiments, a forward pad that includes a leading portion may be used to clean an interior corner of a room where two baseboards meet. Referring again to FIG. 5, a user may operate the apparatus along a first baseboard 102. When the apparatus reaches corner 104, the leading portion 20' may abut second baseboard 106. A user may move the apparatus so that leading portion 20' cleans second baseboard 106 near corner 104. The remainder of pad 20 may clean first baseboard 102 near corner 104.

Figure 6:
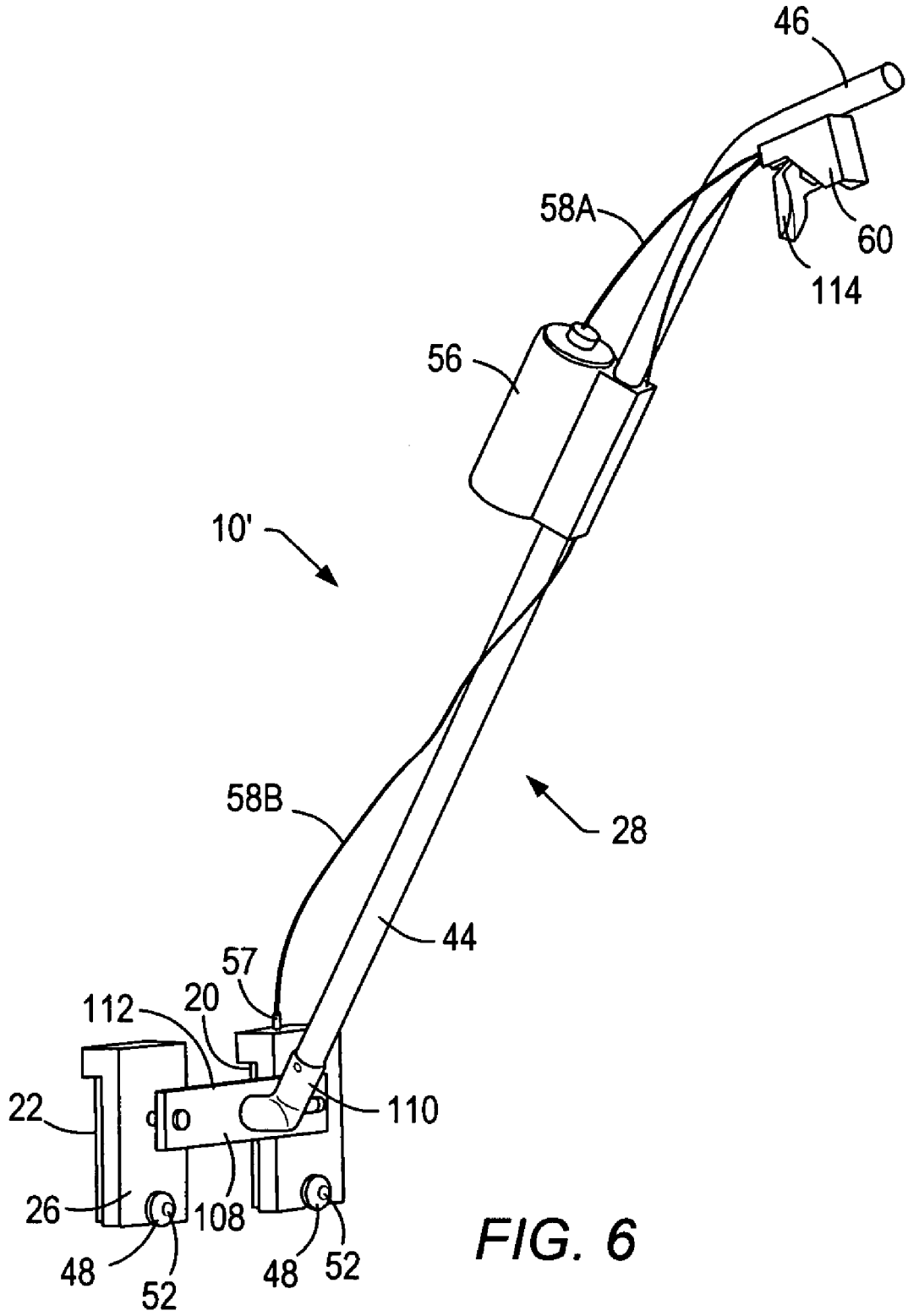
FIG. 6 depicts an embodiment of a baseboard cleaner.

In another embodiment, a pair of pad holders may be coupled by an interconnecting member to a handle at a location between the two pad holders. FIG. 6 depicts apparatus 10' including pad holders 24, 26, each coupled to one end of interconnecting member 108. Handle 28 may be coupled to interconnecting member 108 at pivot joint 110. In an embodiment, pivot joint 110 may allow rotation of handle 28 about an axis perpendicular to face 112 of interconnecting member 108. An angle between handle 28 and a plane of a wall may remain substantially constant as the handle pivots about the axis. In another embodiment, pivoting joint 110 may include a ball joint that allows rotation about an unlimited number of axes. Apparatus 10' may be operated along a baseboard to clean the baseboard. Reaction forces of the baseboard against pad holders 24, 26 may completely or partially balance each other during use to inhibit rotation of pads away from the baseboard.

In an embodiment, pump 6O may be activated by trigger 114. Operation of trigger 114 may pump a fluid from liquid dispenser 56 through tube 58A, pump 60, and tube 58B to port 57. Port 57 may be located at the top of holder 24. Distribution of the fluid in pad 20 from port 57 may be promoted by gravity.

Figure 7B:
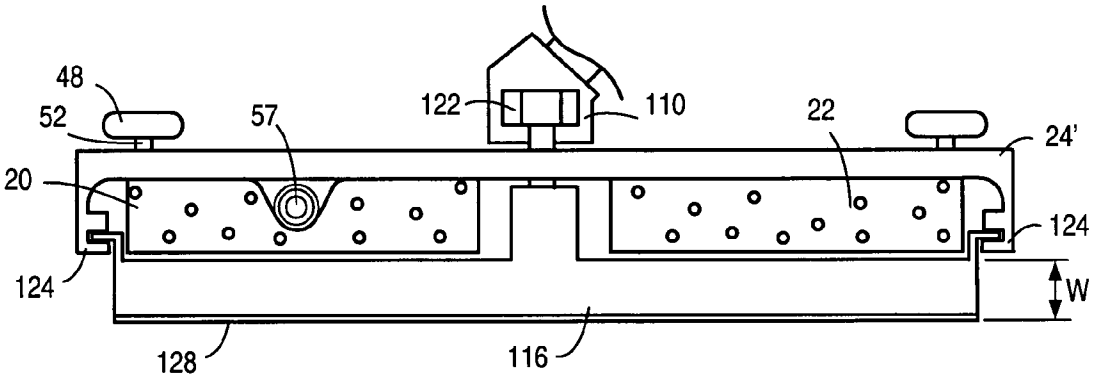
FIGS. 7A-7C depict a holder for a baseboard cleaner coupled to a vertically adjustable top pad holder.
Figure 7A:
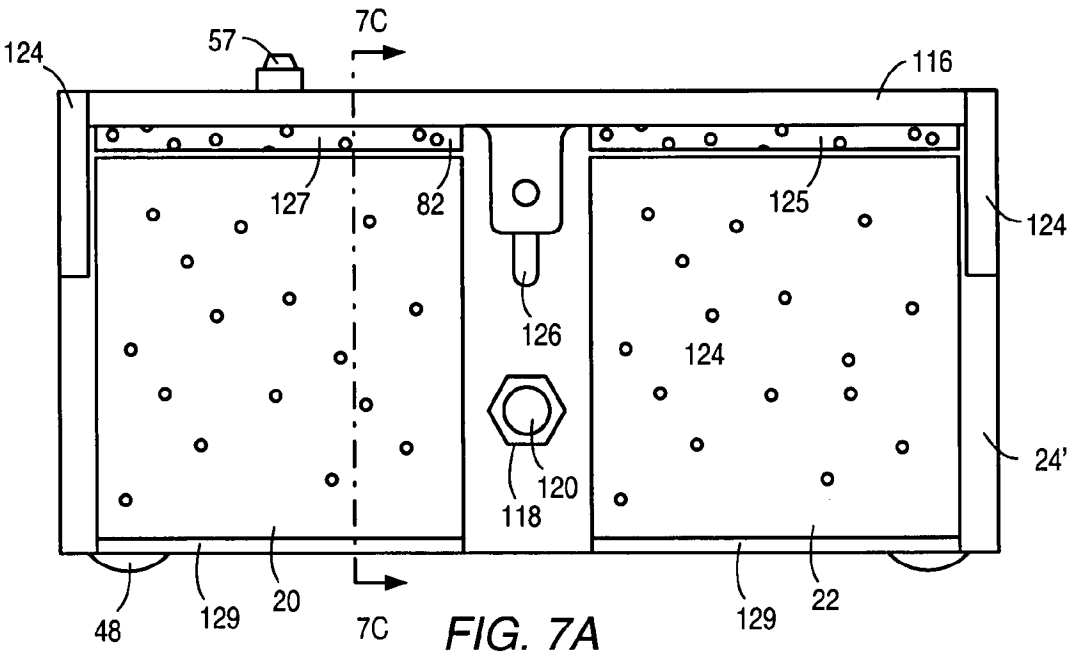
Figure 7C:
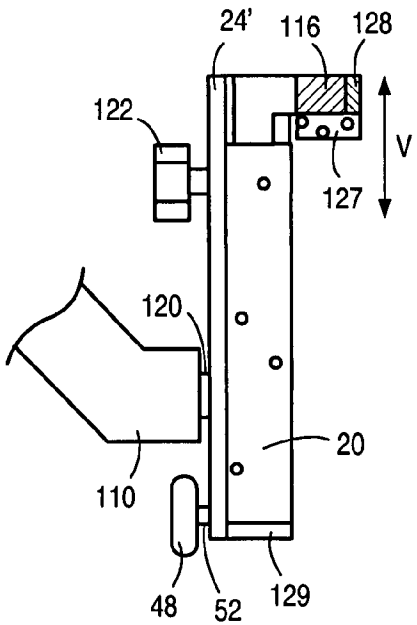

In an embodiment, pads for cleaning a top face of a baseboard may be adjustable to facilitate cleaning of baseboards of various heights. FIGS. 7A and 7B depict pad holder 24' coupled to pads 20, 22. FIG. 7C depicts a cross-sectional view of pad holder 24' taken substantially along 7C-7C of FIG. 7A. Pad holder 24' may be coupled to pivoting joint 110 by threading nut 118 onto threaded post 120. Wheels 48 may be coupled to pad holder 24' at axles 52. Top pad holder 116 may be coupled to pad holder 24' using fastener 122. Top pad holder 116 may run along guides 124 of pad holder 24'. In an embodiment, fastener 122 may include a thumbscrew. A user may loosen fastener 122 so that the user may slide fastener 122 up or down slot 126 (as indicated by arrows V) until top pads 125, 127 are at a desired height relative to the bottom of pad holder 24'. The desired height may be approximately equal to a height of a baseboard to be cleaned. A user may tighten fastener 122 to lock top pad holder 116 at the desired height. Fluid may be introduced into pad 20 through fluid port 57.

Top pad holders 116 may be removed and replaced. In an embodiment, a user may be provided with a set of top pad holders 116 of various widths W. Top pads 125, 127 may be preinstalled on each top pad holder. A user may select a top pad holder that is a suitable width for a baseboard to be cleaned.

In some embodiments, guards may be provided to protect surfaces of baseboards, walls, or floors from mechanical damage (e.g., scratching, marring, or puncturing) or exposure to fluids by a cleaning apparatus. FIGS. 7B and 7C depict guard 128 on the side of top pad holder 116. FIGS. 7A and 7C depict guards 129 at the bottom of pads 20, 22. Guards 128 and 129 may be formed of a soft material including, but not limited to, plastic and/or rubber. Guard 128 may inhibit scratching of a wall during use of the apparatus. Guard 129 may inhibit fluids from seeping onto a carpet or other floor covering during use of the apparatus.

Figure 8B:
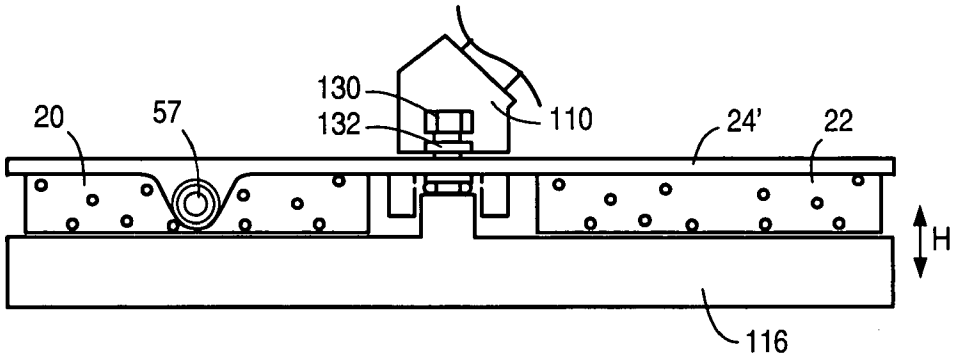
FIGS. 8A-8C depict a holder for a baseboard cleaner coupled to a vertically and horizontally adjustable top pad holder.
Figure 8A:
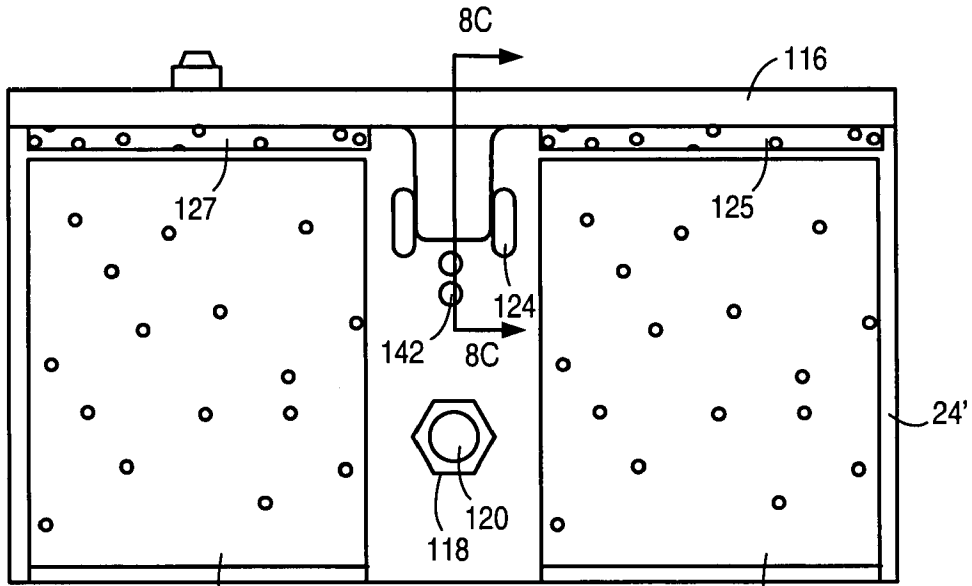
Figure 8C:
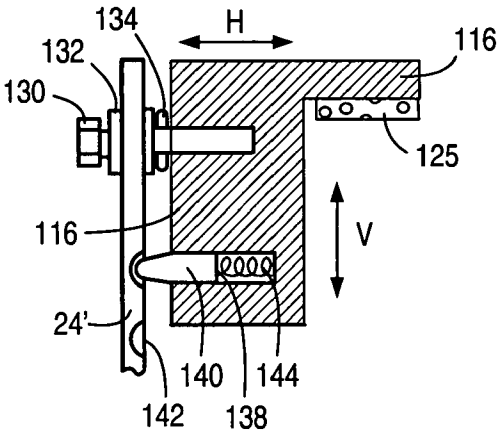

In an embodiment, top pads may be adjustable in both vertical and horizontal directions. FIGS. 8A and 8B depict pad holder 24' coupled to adjustable top pad holder 116. FIG. 8C depicts a cross-sectional view taken substantially along 8C-8C of FIG. 8A. Top pad holder 116 may be coupled to holder 24' using captive fastener 130. Captive fastener 130 may threadably engage top pad holder 116. Captive fastener 130 may rotate within collar 132. Ring 134 may retain captive fastener 130 on collar 132. As captive fastener 130 is turned, a spacing between top pad holder 116 and pad holder 24' may be increased or decreased to move top pad holder 116 horizontally (as indicated by arrows H). Adjusting the spacing between top pad holder 116 and pad holder 24' may facilitate cleaning baseboards of differing thicknesses.

Collar 132 may slide vertically in a slot in pad holder 24'. Top pad holder 116 may include detent mechanism 138. Detent mechanism 138 may include pin 140. Pin 140 may be resiliently urged by spring 144 against one of depressions 142 in pad holder 24'. A user may adjust a height of top pads 125, 127 relative to a floor by gripping captive fastener 130 and moving captive fastener 130 up or down until pin 140 engages one of depressions 142. Engagement of pin 140 in a depression may keep top pads 125, 127 at a desired height during use.

As noted above, the drawings and detailed description thereto are not intended to limit the invention to the particular form disclosed. For example, although the embodiments described herein depict an apparatus including two pads, it will be understood that embodiments may include only one pad, or more than two pads. As another example, although the embodiments described herein depict a handle adapted for manual use, it will be understood that the handle could be coupled to a machine, including, but not limited to, an automatic cleaning machine, a motorized cart, or a robotic device.

In this patent, certain U.S. patents have been incorporated by reference. The text of such U.S. patents, is, however, only incorporated by reference to the extent that no conflict exists between such text and the other statements and drawings set forth herein. In the event of such conflict, then any such conflicting text in such incorporated by reference U.S. patents is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An apparatus for cleaning a baseboard of a wall, comprising:

a plurality of pads; and a handle coupled to the pads;

wherein the plurality of pads comprises two or more front pads, wherein the two or more front pads comprise substantially planar front surfaces, wherein the substantially planar front surfaces are substantially co-planar with one another, and wherein the substantially planar front surfaces are configured to simultaneously contact a front face of the baseboard during use such that the substantially planar front surfaces of the two or more front pads can be sequentially wiped across the front face of the baseboard in a single motion;

wherein the plurality of pads comprises one or more top pads adjacent to one or more of the front pads, wherein at least one of the one or more top pads is configured to contact a top face of the baseboard when the substantially planar front surfaces of the two or more front pads are in contact with the front face of the baseboard, wherein at least one of the one or more top pads is configured to wipe the top face of the baseboard at the same time the two or more front pads wipe the front face of the baseboard.

2. The apparatus of claim 1, further comprising a liquid dispenser, wherein the liquid dispenser is configured to provide a liquid to at least one of the pads when the liquid dispenser is operated by a user.

3. The apparatus of claim 1, wherein one of the pads comprises a sponge, and wherein another of the pads comprises a dry pad.

4. The apparatus of claim 1, wherein at least one of the one or more top pads is adjustable with respect to at least one of the front pads.

5. The apparatus of claim 4, wherein at least one of the top pads is vertically adjustable.

6. The apparatus of claim 1, further comprising a pad holder for at least one of the pads and at least one roller coupled to the pad holder.

7. The apparatus of claim 1, wherein at least one of the pads is removable, reversible, and washable.

8. The apparatus of claim 1, wherein the handle comprises a grip end portion, wherein the grip end portion is angled with respect to an adjoining portion of the handle for the comfort of a user.

9. The apparatus of claim 1, wherein at least one of the one or more top pads is adjacent to and substantially perpendicular to one of the two or more front pads.

10. The apparatus of claim 1, wherein one of the front pads is a first front pad and another of the front pads is a second front pad, and wherein the one or more top pads comprise a first top pad adjacent to the to first front pad and a second top pad adjacent to the second front pad, wherein the first top pad and the second top pad are configured to be sequentially wiped across the top face of the baseboard when the front pads are sequentially wiped across the front face of the baseboard.

11. The apparatus of claim 10, wherein the at least one of the first top pad and the second top pad are vertically adjustable relative to the first front pad and the second front pad.

12. The apparatus of claim 10, further comprising a liquid dispenser, wherein the liquid dispenser is configured to provide a liquid to the first front pad or the first top pad.

13. The apparatus of claim 1, wherein one of the front pads is a first front pad and another of the front pads is a second front pad, and wherein the one or more top pads comprise a first top pad adjacent to the first front pad and a second top pad adjacent to the second front pad, wherein the first top pad and the second top pad are configured to be sequentially wiped across the top face of the baseboard when the front pads are sequentially wiped across the front face of the baseboard, the apparatus further comprising a pad holder for at least one of the pads and at least one roller coupled to the pad holder, wherein the at least one roller is configured to roll along a floor below the baseboard as the first front pad and the second front pad are wiped across the front face of the baseboard and the first top pad and the second top pad are wiped across the top face of the baseboard.

14. An apparatus for cleaning a baseboard of a wall, comprising:

a plurality of pads, wherein the plurality of pads comprises two or more front pads, wherein the two or more front pads comprise substantially planar front surfaces, wherein the substantially planar front surfaces are substantially co-planar with one another; and wherein the substantially planar front surfaces are configured to simultaneously contact a front face of the baseboard during use such that the substantially planar front surfaces of the two or more front pads can be sequentially wiped across the front face of the baseboard in a single motion;

wherein the plurality of pads comprises one or more top pads adjacent to one or more of the front pads, wherein at least one of the one or more top pads is configured to contact a top face of the baseboard when the substantially planar front surfaces of the two or more front pads are in contact with the front face of the baseboard, wherein at least one of the one or more top pads is configured to wipe the top face of the baseboard at the same time the two or more front pads wipe the front face of the baseboard;

a handle coupled to the pads;

a liquid dispenser, and wherein the liquid dispenser is configured to provide a liquid to at least one of the pads during use.

15. The apparatus of claim 14, wherein at least one of the pads comprises a sponge, wherein another of the pads comprises a dry cloth, and wherein the liquid dispenser is configured to provide a liquid to the sponge when the liquid dispenser is operated by a user.

16. The apparatus of claim 14, wherein the liquid dispenser comprises a container, wherein the container is coupled to a pump, and wherein the pump is configured to pressurize a liquid in the container during use of the liquid dispenser.

* * * * *